US005090487A

United States Patent [19]

Masse

[11] Patent Number: 5,090,487

[45] Date of Patent: Feb. 25, 1992

[54] DRILL HEAD WITH INTEGRAL IMPACT HAMMERS

[76] Inventor: Roger F. Masse, 1132 Bérard Ave., Val d'Or, Québec, Canada, J9P 3T9

[21] Appl. No.: 679,764

[22] Filed: Apr. 3, 1991

[30] Foreign Application Priority Data

Feb. 22, 1991 [CA] Canada ..... 2036883

[51] Int. Cl.[5] ..... E21B 4/16

[52] U.S. Cl. ..... 173/111; 173/133; 173/139; 175/53; 175/96

[58] Field of Search ..... 173/111, 133, 139; 175/53, 96

[56] References Cited

U.S. PATENT DOCUMENTS

| | | | |
|---|---|---|---|
| 3,144,086 | 8/1964 | Kurt et al. | 175/96 |
| 3,297,099 | 1/1967 | Adams et al. | 175/53 |
| 3,682,258 | 8/1972 | Kelly, Jr. et al. | 175/96 |
| 3,870,113 | 3/1975 | Slawson | 175/96 |
| 4,410,053 | 10/1983 | Masse . | |
| 4,840,235 | 6/1989 | Masse . | |
| 4,883,133 | 11/1989 | Fletcher et al. | 175/96 |

*Primary Examiner*—Frank T. Yost
*Assistant Examiner*—Scott A. Smith
*Attorney, Agent, or Firm*—Eckert Seamans Cherin & Mellott

[57] ABSTRACT

A drill head is disclosed, for use to drill a hole in a front of hard material such as rock, which comprises a main body acting at a central support, an upwardly projecting spindle secured on top of the main body, the spindle having a vertical axis, a fixation head on top of the spindle for detachably connecting it to a drill shaft operable in use to rotate the drill head about the vertical axis of the spindle and to pull it up toward the front hard material to be drilled, and at least two impact hammers mounted onto the main body in such a manner as to fragment, in use the hard material of the front along at least one circular path centered onto the vertical axis, each impact hammer having a hollow casing, a pneumatically-operated, impact generating assembly enclosed within the casing, and a drill bit actuated by the impact-generating assembly. Advantageously, the hollow casings of the impact hammers are integral with the main body and form therewith a single structural piece, the central cavities of the hollow casings consisting of longitudinal holes made in this single piece and extending in directions substantially parallel to the vertical axis of a spindle at short distances from this axis.

15 Claims, 2 Drawing Sheets

DRILL HEAD WITH INTEGRAL IMPACT HAMMERS

BACKGROUND OF THE INVENTION a) Field of the Invention

The present invention relates to an improved drill head for use to drill a hole in a front of hard material such as rock.

The invention more particularly relates to an improved drill head of the type disclosed, by way of examples, in U.S. Pat. Nos. 4,410,053 and 4,840,235 both granted to the present inventor, which drill head is specially designed to drill large vertical holes such as ventilation, escape and/or safety shafts in mines.

b) Brief Description of the Prior Art

To drill large vertical holes in the mining industry, it is of common practice first to drill with a drill shaft, a small pilot hole from the surface down to the gallery where a vertical shaft is to be provided, and then to use the drill shaft to pull upwardly from the gallery a large drill head, while using the pilot hole to guide it.

The large drill head that is used in the second step of the above mentioned method, basically comprises:

a main body acting as a central support;

an upwardly projecting spindle secured on top of the main body, the spindle having a vertical axis and being preferably sized to fit into the pilot hole to guide the drill head;

a fixation head on top of the spindle for detachably connecting it to the drill shaft which is operable in use to rotate the drill head about the vertical axis of the spindle and to pull it up toward the front of hard material to be drilled; and at least two and preferably three impact hammers mounted onto the main body in such a manner as to fragment in use the hard material of the front along at least one and preferably two circular path(s) centered onto the vertical axis, each impact hammer having a hollow casing, a pneumatically-operated, impact-generating assembly enclosed within the casing and a drill bit actuated by the impact generating assembly.

The drill heads that are disclosed in the above mentioned U.S. patents are examples of this type of drill head, which distinguish over the other existing drill heads of the same type in that their impact hammers are located so that the inner circular path be spaced apart from the pilot hole and that each outer circular path, if any, be spaced apart from the inner one and from each other, and project at different vertical level. As a result, the hard material is fragmented by impact along each path and simultaneously by shear betwen the pilot hole and the inner path and between each set of adjacent paths, if any, thereby making the drilling operation much faster than with a conventional drill head of the above mentioned type.

If the above mentioned drill heads are quite efficient, their use presents several drawbacks due to their particular construction.

A major one of these drawbacks is the manner in which the hammers are fixed to the main body acting as central support. In U.S. Pat. No. 4,410,053, this is done by means of a pair of pillow-blocks, each involving a half cylindrical seat which is fixed to the central support, by bolting or welding, and into which one end of the cylindrical casing of the hammer rests, this end being clamped in the seat by a metal strap bolted to the seat and forcing the hammer case against it. Under the severe action of the impact hammers in use, the bolts of the pillow-blocks rapidly become loose or the straps or seat break, necessitating break-down of the operation for tightening of the bolts or for repair.

In order to tentatively overcome or at least reduce this major drawback, it has been suggested to use impact hammers each provided with a one-piece cast casing including a connection flange on each side of its longitudinal axis. These flanges which preferably extend the full length of the case, can be bolted to the central support, thereby transmitting the hammer blows directly to the central support and thus appreciably reducing any tendency of the bolts to become loose.

This solution has some advantages, but it calls for a very specific casting which is quite heavy and thus makes the drill head provided with at least two of them very heavy.

Another major drawback of the existing drill heads like the one of U.S. Pat. No. 4,410,053, is that their upper sub-member which receives and guides the drill bit, is merely screwed into the corresponding end of the hammer casing. In operation, this sub-member becomes loose under the severe blows applied to it by the repeated hammering action of the drill bit, rendering break-down adjustment necesary.

In order to tentatively overcome this other major drawbvack and thus avoid loosening of the upper sub-member, it has also been suggested to use impact hammers each comprising a one-piece cast casing formed with radial connection ears at the "sub end" therof. Each hammer also comprises an upper sub-member which has radial connection ears operatively engaging over the casing connection ears while bolt means releasably secure the drive sub-member and casing together through the connection ears.

Once again, this solution has some advantages but it calls again for a very specific casting.

OBJECTS OF THE INVENTION

A first object of the present invention is to provide a drill head of the above mentioned type, whose structure overcomes or at least largely reduces the above mentioned drawbacks of the existing drill heads.

Another object of the invention is to provide a new drill head of the above mentioned type whose structure is such that the life duration of the drill bits of the impact hammers used therein is appreciably lengthened.

A further object of the invention is to provide a new drill head of the above mentioned type, which is simple in structure and whose major components, including in particular those of the impact hammers, may be easily replaced whenever necessary, thereby making maintenance of the drill head much easier and faster to carry out.

SUMMARY OF THE INVENTION

The drill head according to the invention as broadly claimed hereinafter, is of the above mentioned type and thus comprises:

a main body acting as a central support, this main body having a top end and a bottom end;

a spindle secured to the top end of the mainbody, and upwardly projecting from this mainbody, the spindle having a vertical axis;

means for detachably connecting the spindle to a drill shaft extending in a pilot hole made into a front of hard material to be drilled; the drill shaft being operable in use to rotate the drill head about the vertical axis of the spindle, and to pull it up toward the front of hard material; and at least two impact hammers mounted onto the main body in such a manner as to fragment in use the hard material of this front along at least one circular path centered onto the vertical axis of the spindle, each of the impact hammers comprising:

a hollow casing defining a central cavity having an upper open end and a lower end, this central cavity having a longitudinal axis substantially parallel vertical axis of the spindle;

a an, impact generating assembly enclosed within the central cavity of the casing; and a drill bit slidably mounted, guided and retained into the upper open end of the casing, the drill bit projecting away from the upper open end toward the front of hard material and being actuated by the impact generating assembly to fragment the hard material by impact along one of the circular path(s).

The drill head according to the invention is characterized in that the hollow casings of its impact hammers are integral with the main body and form therewith a single structural piece, the central cavities of the hollow casings consisting of longitudinal holes made in this single piece, these holes extending in directions substantially parallel to the vertical axis of the spindle at short distances from this axis.

By making the hollow casings of the impact hammers integral with the main body, the inention very simply yet efficiently overcomes the above mentioned first major drawback of the prior art. Indeed, the impact hammers cannot anymore become loose. It also overcomes the drawbacks of the previously suggested solution. Indeed it does not call anymore for the casting of impact hammer casings with a heavy integral connection flange to be connected with bolts to a heavy plate forming part of the main body.

In accordance with a first preferred embodiment of the invention, a pressure roller assembly of conventional structure is mounted at the bottom end of the main body to absorb lateral vibrations and guide the drill head within the hole as the drilling operation proceeds. To do so, the pressure roller assembly which is preferably fixed to a post integrally projecting from the bottom of the main body, must of course have a central axis coaxial with the vertical axis of the spindle.

In accordance with another preferred embodiment of the invention, the impact hammers are located in such a manner that the circular path that is centered onto the vertical axis of the spindle and is adjacent to the pilot hole, is spaced apart from this pilot hole, and the spindle comprises a conical portion tapering outwardly downwardly, hole and causing, in use, the hard material to be fragmented by shear between the pilot hole and the adjacent circular path.

In accordance with a further preferred embodiment of the invention, the drill bit of each impact hammer has a rearward stem and is slidably mounted, guided and retained into the upper end of the hole defining the central cavity of impact hammer by engagement of its stem into a longitudinal bore provided in an upper sub-member having a reary cylindrical portion screwed inside this hole and a top flange portion extending out of the hole. The upper sub-member is advantageously prevented from inadvertantly unscrewing from the hole by means of a torsion spring externally mounted around the upper sub-member, the torsion spring being coaxial with the hole and having one end fixed to the top flange portion of the upper sub-member and another end fixed to the main body.

The rearward stem of the drill bit preferably has a rear end formed with a retaining flange having an outer diameter sized to pass through the longitudinal bore of the upper sub-member and free to rotate therein. This rear end extends into the hole past the rear cylindrical portion of the upper sub-member and is retained therein by a retaining ring having an inner diameter smaller than the outer diameter of the retaining flange. Advantageously, this retaining ring is mounted below and retained by the upper sub-member within the hole, it is however spaced from the rear cylindrical portio of the upper sub-member by an annular, shock-absorbing spring.

This particular mounting of the drill bit on top of each hammer is very interesting. Indeed, it has been discovered in use that the best approach to increasing the life expectancy of each drill bit is to give it complete freedom of rotation with respect to the casing carrying it while limiting, of course, the stroke of its rectilinearly reciprocating motion. It has indeed been found that the teeth of the drill bit then adjust themselves better and more readily to the varying degree of roughness of the rock surface, immediately upon impact, by avoiding too large a blow on a limited number of teeth or, in other words, distributing the impact force more evenly between the teeth. Extensive studies and tests have shown an important improvement in this respect and appear to support the aforesaid assumption.

Moreover, the use of a shock absorbing spring to "protect" to some extent the bottom edge of the upper sub-member from the blows imparted by the retaining flange of the drill bit, has also proved to be very useful to increase the life expectancy of each hammer.

In the drill head according to the invention, the pneumatically operated, impact generating assembly preferably comprises a reciprocable impact piston slidably mounted within a portion of the hole under the stem of the drill bit, this hole being provided at its bottom end with a counterbore extending upwardly over this portion of said hole in which the impact piston is mounted, this counterbore housing an interchangeable tubular lining held in place by a lower sub-member having a fixation flange bolted to the single piece formed by the main body and casings, at the bottom end of this hole.

The pneumatically operated, impact generating assembly also comprises interconnected, compressed air supply conduits bored into the single piece formed by the main body and casings and into the lower sub-member and the tubular lining of each impact hammer, as well as compressed-air exhaust conduits bored into the impact piston and drill bit of each impact hammer.

BRIEF DESCRIPTION OF THE DRAWINGS

The structure and advantages of the drill head according to the present invention will be better understood upon reading of the following, non restrictive description of a preferred embodiment thereof, made with reference to the accompanying drawings in which.

DESCRIPTION OF A PREFERRED EMBODIMENT

Figure 1:
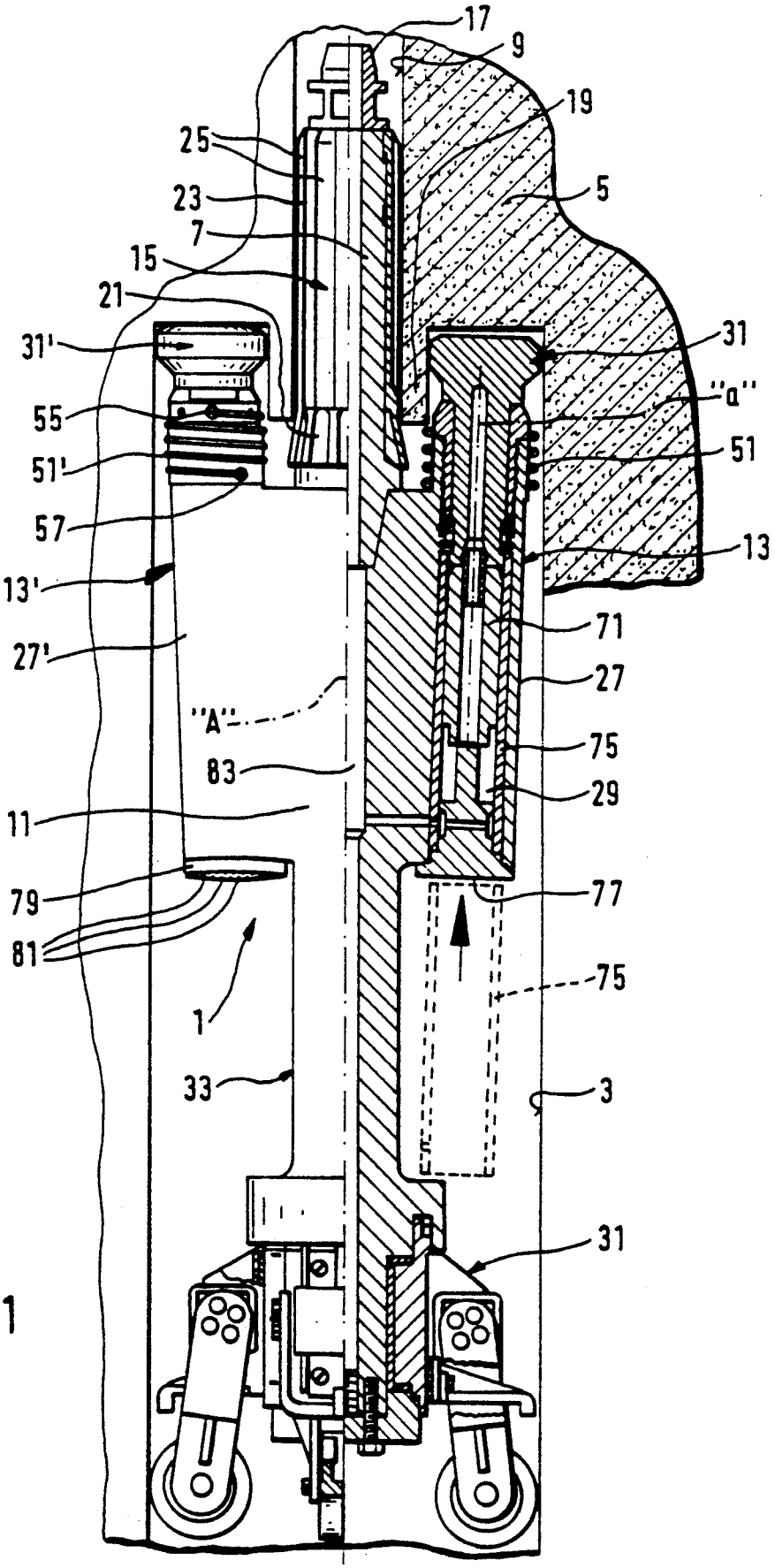
FIG. 1 is a side elevational view of a drill head accoridng to the invention in use in drilling a hole in a front of hard material, the drill head being shown in partial cross-section.

The drill head 1 according to the invention as shown in FIG. 1 is intended to be used for drilling a hole 3 in a front of hard material 5.

It basically comprises a main body 11 acting as a central support for at least two impact hammers 13, 13', which are mounted and positioned in such a manner as to fragment in use the hard material of the front 5 along at least one circular path 7 centered onto a vertical axis A.

In practice, the drill head 1 may comprise more than two impact hammers 13, 13' positioned at different radial distances from the axis A, in order to fragment by impact the hard material along more than one circular path centered onto the vertical axis, especially if a large hole 3 is to be drilled.

As shown in FIG. 1, the impact hammers 13 and 13' may be positioned in such a manner as to fragment the rock along the same circular path 7. However, they may also be positioned at different radial distances so as to fragment the hard along the coaxial circular paths, as is disclosed, by way of example, in U.S. Pat. No. 4,410,053 to the same inventor.

The drill head 1 also comprises an upwardly projecting spindle 15 screwed or otherwise secured on top of the main body 11. The spindle 15 has a vertical axis which is coaxial with the axis A, and it is preferably sized to fit into a small pilot hole 9 drilled into the front of hard material 5.

Means are provided on top of the spindle 15 for detachably connecting it to a drill shaft extending in the pilot hole 9. These means preferably comprise a fixable head 17 that can be locked onto the drill shaft which is used firstly to drill the pilot hole 5 and, secondly to rotate the drill head 1 about the vertical axis A and to pull it up toward the front of hard material 5.

In accordance with a preferred embodiment of the invention, the impact hammers 13 and 13' are advantageously positioned and oriented in such a manner that the circular path 7 which is adjacent the pilot hole 9 is, in fact, slightly spaced apart from this pilot hole 9, thereby leaving a ring 19 of non-fragmented rock between the circular path 7 and the pilot hole 9. In such a case, the spindle 15 preferably comprises, at its bottom end, a conical portion 19 tapering outwardly downwardly, this conical portion being larger than the pilot hole 9 so that, in use, the ring 19 of hard material is fragmented by shear while the drill head is moving up.

The portion 23 of the spindle extending above the conical portion 21 is preferably cylindrical and sized to fit into the pilot hole 9 in order to act as a guide for the drill head 1 while it is pulled up by the drill shaft.

To reduce friction as much as possible the cylindrical portion 23 of the spindle may be provided with a plurality of vertical splines.

Each impact hammers 13, 13' comprises a hollow casing 27, 27' defining a central cavity 29 having a longitudinal axis "a" substantially parallel to the vertical axis "A", although it can be slightly inclined in a tangential plane as it is known for this kind of machine. The centraly cavity 29 encloses a pneumatically operated, impact-generating assembly that will be described in greater details hereinafter.

A drill bit 31, 31' is slidably mounted into the upper end of each casing 27, 27', in such a manner as to project away from this upper end toward the front of hard material 5 to be drilled. Of course, the drill bit 31, 31' is actuated by the impact-generating assembly to fragment the hard material along each circular path 7.

In accordance with the invention, the hollow casings 27, 27' of all the impact hammers 13, 13' are integral with the main body 11 and form therewith a single structural piece that can be cast and machined as is known per se. The casings 27, 27' preferably extend as lateral projections or wings, symmetrically around the main body 11 to reduce as much as possible the total weight of the machine while balancing it as much as possible.

The central cavity 29 of each hollow casing 27 consists of a longitudinal hole made in the one single piece, each hole hereinafter numbered 29 as was the cavity, extending in a direction substantially parallel to the vertical axis "A" at a short distance thereof, as was explained hereinabove.

Advantageously, a pressure roller assembly 31 of known structure is mounted onto a post 33 integral with the single piece formed by the main body 11 and casings 27, 27' the post 33 projecting downwardly from the main body 11 and acting as bottom thereof. The utility of the pressure roller assembly 31 is essentially to absorb lateral vibrations and to guide the drill head 1 within the hole 3 to be drilled as the drilling operation proceeds. Of course, to make such a guiding efficient, it is compulsory that the pressure roller assembly 31 has a central axis coaxial with the vertical axis A and, of course, the spindle 15.

Figure 2:
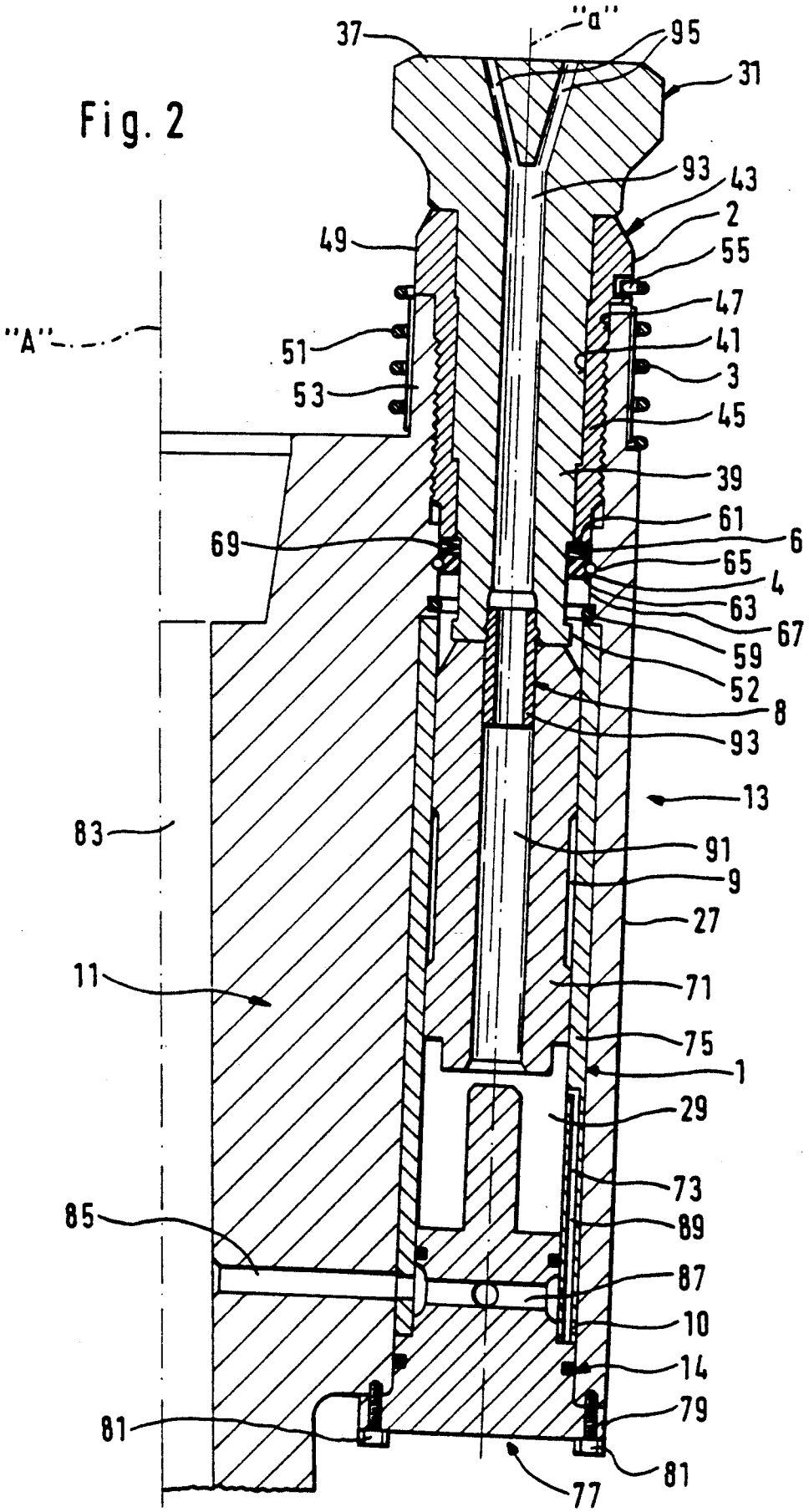
FIG. 2 is a side elevational, cross-section view of one of the impact hammers of the drill head shown in FIG. 1.

As better shown in FIG. 2 the drill bit 31 of each impact hammer 13 has a flat impact head 37 that can be provided with carbide inserts or teeth (not shown) and extend out of the casing 27, and a rearward stem 39. The drill bit 31 is slidably mounted, guided and retained into the upper end of the hole 29 defining the central cavity of the impact hammer 27, by engagement of its stem 39 into a longitudinal bore 41 provided in an upper submember 43 having a rear cylindrical portion 45 screwed into a counterbore 47 provided for this purpose in the upper portion of the hole 29, and a top flange portion 49 extending out of the hollow cavity 29.

In accordance with the invention, the upper submember 43 screwed on top of the hollow cavity 29 is simply yet efficiently prevented for inadvertant unscrewing by means of a torsion spring 51 externally mounted around an upwards projection 53 of the casing 27, integral with the single piece, and around the upper sub-member 43, as is shown both in FIGS. 1 and 2. In such a position, the torsion spring 51 is coaxial with the hole 29. As better shown on the left side of FIG. 1, each torsion spring 51 has one end 55 fixed to the top flange portion 49 of the upper sub-member 43, and another end 57 fixed to the single piece formed by the main body and casings, such a fixation being achieved by insertion into holes provided for this purpose of both of the elements.

As can be understood, the torsion spring 51 exert a constant torque onto the upper member 43 and thus keeps the same screwed into the upper portion of the hole 29. Thanks to its non-rigid structure, the spring 51 is more resistant than any other rigid locking means that could be used for the same purpose.

Referring again to FIG. 2, the rearward stem 45 of the drill bit 31 has a rear end formed with a retaining flange 59 having an outer diameter sized to pass through the narrowest portion of the longitudinal bore 41 of the upper sub-member 43 which, as is shown, is slightly narrowing from top to bottom, to form a plurality of steps.

Advantageously, the stem 45 and the bore 41 of the upper sub-member 43 are both shaped so that the drill bit 31, is free to rotate within the bore 41 about the longitudinal axis "a". The fact that the drill 31 may freely rotate within the upper sub-member 43 is very interesting. Indeed, as already indicated in the preamble of the present disclosure, the teeth of the drill bit may then adjust themselves and more rapidly to the varying degree of roughnesses of rock surface, immediately upon impact, thereby improving the distribution of the impact forces between the teeth and thus substantially increasing the life expectancy of the drill bit.

Of course, the teeth provided on top of the flat impact head 37 of the drill bit 31 must be symetrically positioned to take into consideration this freedom of rotation about the axis "a".

The length of the stem 39 of the drill bit is selected so that the retaining flange 59 at the rear end thereof extends into the hole 29 past the rear edge 61 of the rear cylindrical portion 45 of the upper sub-member, over a length corresponding to the desired impact stroke that the drill bit must have.

The drill bit 31 is retained within the bore 41 by means of a retaining ring 63 held in position within the hole 29 by means of a O-ring 65 engaged into a small grove made into the internal wall of the hollow 29. Of course, to perform its retaining function, this retaining ring 63 must have an inner diameter smaller than the outer diameter of the retaining flange 59 which, as shown in FIG. 2, can be defined by a cylindrical recess 63 provided at the bottom of the stem 39.

The retaining ring 63 which is mounted below the upper sub-member 43 and retains within the hole 29 by the ring 63, is advantageously spaced from the rear edge 61 of the rear cylindrical portion 45 of the upper sub-member 43, by an annular, shock-absorbing spring 69. The utility of this spring is to essentially to absorb the impact energy of the drill bit when the same is moved up by the impact-generating assembly and the flange 59 comes into contact with the retaining ring 63. Once again, this feature improves the life expectancy of the impact hammer 13, 13'.

The pneumatically operated, impact-generating assembly forming the "motor" of each impact hammer comprises reciprocable impact piston 71 that is slidably mounted within a portion of the hole 29 under the stem 39 of the drill bit 31. In order to improve again the life expectancy of each impact hammer, the hole 29 is provided at its bottom end with a counterbore 73 extending upwardly from the bottom of the hole up to and over this portion of the hole in which the impact piston 71 is mounted. The counterbore 73 is sized to house an interchangeable tubular lining 75 can be inserted as shown in the left side of FIG. 1. This lining 73 is helding place by a lower sub-member 77 having a fixation flange 79 fixed by means of bolts 81 to the single piece formed by the main body and the casings, at the bottom end of the hole 29.

The pneumatically operated, impact-generating assembly also comprises interconnected, compressed-air supply and exhaust conduits to stroke the piston 71 at regular interval and have it hit the drill bit. These compressed-air supply and exhaust conduits are very similar in use and operation to those disclosed in great details in U.S. Pat. No. 4,840,235. They basically comprise a main supply conduit 83 longitudinally extending within the main body 11, post 33 and spindle 15, in such a manner as to allow a compressed air source to be connected either on top of the spindle or at the bottom of the post 33. A radial derivation conduit 85 is provided into the main body 11, leading from the main conduit 83 to the bottom of each hole 29. Each derivation conduit 85 opens into radial bores 87 provided in the lower sub-member 79. A plurality of admission conduits 89 that can be drilled into the lining 75, are used to to supply compressed air below the piston 71 to "blow" it up and cause it to hit and move up the drill 31 until the retaining flange 59 reaches the retaining ring 63. In such a retained position, the air below the piston 71 may escape from a longitudinal exhaust bore 91 provided into the piston 71, a cylindrical foot valve attached to the rear end of the stem 39 of the drill bit 31, and a longitudinal bore 93 provided in the drill 31 and ending into a plurality of small air exhauts 95.

Advantageously, a retaining ring 99 can be provided in a groove made in the internal wall of the hole 29, to stop upwardly the piston 71.

Although, in the above disclosure, reference has exclusively be made to the use of the drill head 1 to drill a vertical hole upwardly, it must be understood the same drill head could be used to drill a horizontal or inclined hole in a very same manner, provided of course that it can be connected to a drill shaft extending through a pilot hole and capable of a very same manner, provided of course that it can be connected to a drill shaft extending through a pilot hole and capable of pulling it against a front of hard material to be drilled.

The embodiments of the invention in which an exclusive property or privilege is claimed are defined as follows:

1. A drill head for use to drill a hole in a front of hard material such as rock, said drill head comprising:

a main body having a top end and a bottom end;

a spindle secured to the top end of the main body and upwardly projecting from said main body, said spindle having a vertical axis;

means for detachably connecting the spindle to a drill shaft extending in a pilot hole made into the front of hard material, said drill shaft being operable in use to rotate the drill head about said vertical axis and to pull it up toward said front of hard material; and at least two impact hammers mounted onto the main body in such a manner as to fragment in use the hard material of said front along at least one circular path centered onto said vertical axis; each of said impact hammers comprising:

a hollow casing defining a central cavity having an upper open end and a lower end, said central cavity having a longitudinal axis substantially parallel to said vertical axis;

an impact-generating assembly enclosed within said central cavity of said casing; and a drill bit slidably mounted into said upper open end of said casing, said drill bit projecting away from said upper open end toward said front of hard material and being actuated by said impact-generating assembly to fragment the hard material by impact along one of said at least one circular path;

characterized in that said at least two hollow casings are integral with said main body and form therewith a single structural piece, the central cavities of said hollow casings consisting of longitudinal holes made in said single piece, said holes extending in directions substantially parallel to said vertical axis at short distances thereof.

2. A drill head as claimed in claim 1, characterized in that it also comprises: a pressure roller assembly mounted onto the bottom end of said main body to absord lateral vibrations and guide the drill head within the hole as the drilling operation proceeds, said pressure roller assembly having a central axis coaxial with said vertical axis.

3. A drill head as claimed in claim 2, characterized in that said pressure roller assembly is mounted onto a post integral with said single piece formed by said main body and casings, said post projecting downwardly from said main body and acting as the bottom end thereof.

4. A drill head as claimed in claim 2, characterized in that the impact hammers are located in such a manner that the circular path centered onto said vertical axis and adjacent said pilot hole is spaced apart from said pilot hole, and the spindle comprises a conical portion tapering outwardly downwardly, said conical portion being larger than said pilot hole and causing, in use, the hard material to be fragmented by shear between said pilot hole and the circular path adjacent said pilot hole.

5. A drill bit as claimed in claim 4, characterized in that the spindle also comprises a cylindrical portion extending above said conical portion, said cylindrical portion being sized to fit into said pilot hole and to further guide the drill head.

6. A drill head as claimed in claim 5, characterized in that said cylindrical portion of the spindle is formed with a plurality of vertical splines.

7. A drill head as claimed in claim 6, characterized in that the spindle is detachably secured to the upper end of said main body.

8. A drill head as claimed in claim 2, characterized in that the drill bit of each impact hammer has a rearward stem and is slidably mounted, guided and retained into the upper end of the hole defining the central cavity of said impact hammer by engagement of its stem into a longitudinal bore provided in an upper sub-member having a rear cylindrical portion screwed inside said hole and a top flange portion extending out of said hole, said upper sub-member being prevented from inadvertantly unscrewing from said hole by means of a torsion spring externally mounted around said upper sub-member, said torsion spring being coaxial with said hole and having one end fixed to the top flange portion of the upper sub-member and another end fixed to the main body.

9. A drill head as claimed in claim 8, characterized in that the rearward stem of the drill bit has a rear end formed with a retaining flange having an outer diameter sized to pass through the longitudinal bore of the upper sub-member and free to rotate therein, said rear end extending into the hole past the rear cylindrical portion of said upper sub-member and being retained therein by a retaining ring having an inner diameter smaller than the outer diameter of the retaining flange, said retaining ring being mounted below and retained by said upper sub-member within said hole, and being spaced from the rear cylindrical portion of said upper sub-member by an annular, shock-absorbing spring.

10. A drill head as claimed in claim 8, characterized in that the impact generating assembly is pneumatically operated and comprises a reciprocable impact piston slidably mounted within a portion of said hole under the stem of the drill bit, said hole being provided at its bottom end with a counterbore extending upwardly over said portion of said hole in which the impact piston is mounted, said counterbore housing an interchangeable tubular lining held in place by a lower sub-member having a fixation flange bolted to said single piece formed by said main body and casings, at the bottom end of said hole.

11. A drill head as claimed in claim 9, characterized in that the pneumatically operated, impact-generating assembly comprises a reciprocable impact piston slidably mounted within a portion of said hole under the stem of the drill bit, said hole being provided at its bottom end with a counterbore extending upwardly over said portion of said hole in which the impact piston is mounted, said counterbore housing an interchangeable tubular lining held in place by a lower sub-member having a fixation flange bolted to said single piece formed by said main body and casings, at the bottom end of said hole.

12. A drill head as claimed in claim 11, characterized in that the pneumatically operated, impact-generating assembly also comprises interconnected, compressed air supply conduits bored into the single piece formed by said main body and casings and into the lower sub-member and the tubular lining of each impact hammer, as well as compressed-air exhaust conduits bored into the impact piston and drill bit of each impact hammer.

13. A drill head as claimed in claim 12, characterized in that the impact hammers are located in such a manner that the circular path centered onto said vertical axis adjacent said pilot hole is spaced apart from said pilot hole, and the spindle comprises a conical portion tapering outwardly downwardly, said conical portion being larger than said pilot hole and causing in use the hard material to be fragmented by shear between said pilot hole and the circular path adjacent said pilot hole.

14. A drill bit as claimed in claim 13, characterized in that the spindle also comprises a cylindrical portion extending above said conical portion, said cylindrical portion being sized to fit into said pilot hole and further guide the drill head.

15. A drill head as claimed in claim 14, characterized in that the spindle is detachably secured to the upper end of said main body.

* * * * *